United States Patent [19]

Cameron

[11] 4,257,455

[45] Mar. 24, 1981

[54] DOUBLE SAFETY VALVE FOR STAMPING PRESSES AND THE LIKE

[75] Inventor: Russell J. Cameron, Rochester, Mich.

[73] Assignee: Ross Operating Valve Company, Detroit, Mich.

[21] Appl. No.: 117,119

[22] Filed: Jan. 31, 1980

Related U.S. Application Data

[63] Continuation-in-part of Ser. No. 73,000, Sep. 6, 1979, abandoned.

[51] Int. Cl.[3] ..... F15B 13/043; F15B 20/00

[52] U.S. Cl. ..... 137/596.16; 91/424; 91/448; 137/596.18

[58] Field of Search ..... 91/424, 448; 137/596.16, 596.18

[56] References Cited

U.S. PATENT DOCUMENTS

| | | | |
|---|---|---|---|
| Re. 28,520 | 8/1975 | Mahorney . | |
| 2,906,246 | 9/1959 | Di Tirro et al. . | |
| 3,108,612 | 10/1963 | Hofmann et al. | 137/596.16 |
| 3,757,818 | 9/1973 | Sweet . | |

FOREIGN PATENT DOCUMENTS

| | | | |
|---|---|---|---|
| 2388151 | 11/1978 | France | 137/596.16 |
| 38890 | 8/1965 | German Democratic Rep. . | |
| 1294747 | 11/1972 | United Kingdom | 137/596.16 |

OTHER PUBLICATIONS

Maschinenbautechnik 14, (1965), Heft 6, pp. 300–302.

*Primary Examiner*—Gerald A. Michalsky
*Attorney, Agent, or Firm*—Dickey & Pierce Harness

[57] ABSTRACT

A double safety valve for stamping presses and the like having a monitor responsive to asynchronous pressures, to disenable a press. The assembly comprises two valve stems each being radially supported by a piston at one end and by an outboard bearing at the other end. Each valve stem carries an inlet poppet valve adjacent one end, a spool valve on an intermediate portion and an exhaust valve adjacent the other end. Cross passages connect the inlet poppet valve of each valve stem in series with the spool valve of the other valve stem. A common outlet chamber receives pressurized fluid from both spool valves, this outlet chamber being connected in parallel to both exhaust valves. The assembly thus has the advantages of a double safety valve in which the inlet valves are in series and the exhaust valves in parallel, but is capable of being monitored by a monitor responsive to asynchronous pressures or movements. Pressures at the monitor fluctuate between zero and full pressure with each normal cycle, causing slight shuttle movement which improves monitor reliability. The construction minimizes side loading on the spool valves, thus preventing appreciable wear which could cause leakage upon faulting of one valve element and which in turn could inadvertently continue press operation.

16 Claims, 2 Drawing Figures

DOUBLE SAFETY VALVE FOR STAMPING PRESSES AND THE LIKE

CROSS REFERENCE TO RELATED APPLICATION

This application is a continuation-in-part of application Ser. No. 73,000, filed Sept. 6, 1979 now abandoned, by Russell J. Cameron and assigned to the assignee of the present application.

BACKGROUND OF THE INVENTION

1. Field of the Invention

The invention relates to double safety valves for stamping presses and the like which are used to control the clutch-brake of a press. In such normally closed valves, the two valves are actuated simultaneously to pressurize an outlet port which actuates the clutch and disengages the brake, operating the press. Shifting of the valves to their exhaust position will disengage the clutch and actuate the brake. Discrepant positions between the two valves is intended to result in inability to operate the clutch. The double valve is often monitored in addition, in order to shut off the pressure or electrical supply to the double valves. One form of monitoring is position monitoring which is sensing the actual positions of the valve stems. A more desirable monitoring arrangement in some cases is to sense discrepant pressures between corresponding locations of the double valve. This not only senses a stuck valve regardless of degree of movement but will also monitor poppet seal leaks with certain double valve arrangements.

2. Description of the Prior Art

One double valve arrangement is shown by DiTirro U.S. Pat. No. 2,906,246 in which the flow between the inlet valves and the outlet port is in parallel, as is the flow from the outlet port to the exhaust valves. A disadvantage of this arrangement is that if one valve is stuck in a partially or fully opened position, the valve which moves to its closed or exhaust position must dump not only air from the press clutch motor but also from the stuck main valve. This might result in residual pressure remaining at the outlet port which could delay the setting of the clutch/brake. Restricted inlets are often engineered for this condition.

Another arrangement has the main valves in series; with this system there is a positive supply cutoff when one valve fails in an open position and the other moves to its closed position. However it has been found that if the valve which fails in the open position is the downstream valve, the exhausting of the outlet port is sometimes not fast enough because it must follow a tortuous flow path through the inlet of the downstream valve.

A third arrangement is exemplified by Mahorney U.S. Pat. No. Re. 28,520 and Sweet U.S. Pat. No. 3,757,818. In this arrangement the flow from the inlet port to the outlet port is in series through two inlet valves but the flow from the outlet port to the exhaust port is in parallel through two exhaust valves. While this arrangement overcomes disadvantages of those previously described, it is difficult to monitor discrepant valve positions by measuring asynchronous pressures, as is done with a spool element in the above mentioned DiTirro patent. Instead, one must utilize position monitoring, that is, sensing the relative positions of the valve stems themselves as shown in the Mahorney patent.

East German Pat. No. 38,890 dated Aug. 25, 1965 and the article by Morgenstern in Maschinenbautechnik 14

(1965) Heft 6 show a double valve in which each valve stem has two inlet poppet valves, with cross passages between the upstream poppet valve of one valve stem and the downstream poppet valve of the other stem. This construction has advantages of the series-parallel arrangement shown in the Sweet and Mahorney patents but because of its balanced arrangement is amenable to monitoring by the sensing of discrepant pressures. A disadvantage of this construction is that each valve stem has two poppet valves closing in the same direction which is a difficult construction to manufacture while avoiding leakage problems. Efficient sealing could only be accomplished by providing very precise dimensions in the valve body and similarly precise dimensions controlling the relative closure positions. With less careful dimensions, differences could be compensated for by flexible sealing surfaces or elements, and spring loaded closures. However, these methods would require a longer stem stroke to allow for the additional take-up distance required by the closures.

Herion Werke KG of Fellbach, West Germany has a "sivex" press safety valve with cyclic pressure monitoring. In this valve the balanced series-parallel arrangement of the Morgenstern construction is preserved but spool valves are substituted for the upstream poppet valves. Although this construction avoids the above-mentioned multiple poppet sealing difficulties, it could create other problems with respect to wear and monitoring. In the Herion construction the valve stem is radially supported at one end by the piston and at the other end by the spool valve itself. This type of design has been found to create considerable side pressure and wear on the spool valves during continued operation in handling pressurized air to and from a relatively large volume such as that of a press clutch-brake construction. As a result, if a discrepant position occurs between the two valve stems after some service, some line pressure could pass through a worn spool valve causing a delay in the setting of the clutch/brake. While a monitor would sense discrepant positions between the two valve stems after they occur, it would not sense wearing of the spool valves before the discrepant condition. Furthermore, because of the fact that the upstream inlet valve in the Herion construction is the spool valve, the pressures in the conduits between the upstream and downstream inlet valves is constant. If constant line pressures are used for spool sensing purposes, it has been found that the spool type monitors are not as likely to be reliable when needed.

BRIEF SUMMARY OF THE INVENTION

It is an object of the present invention to provide a novel and improved double safety valve for presses of the balanced series inlet type which obviates disadvantages of previously known double valves of this nature, and avoids the possibility of an unknown and possibly dangerous outlet pressure supply due to an eroded spool valve, should a discrepant position occur between the double valves.

It is another object to provide an improved double safety valve of this character which enhances the operability of a shuttle type of monitor by making available cyclic pressure fluctuations at both ends of the shuttle during normal operation.

Other objects, features and advantages of the invention will become apparent from the following description and claims, and the accompanying drawing.

Briefly, the invention comprises a housing, a pair of valve stems in said housing, pistons slidable in housing cylinders at one end of said valve stems, extensions at the other ends of said valve stems slidable in bearings in said housing, whereby the valve stems are radially supported at their opposite ends by said cylinders and bearings, an inlet chamber, poppet valves on said valve stems in said inlet chamber, spool valves on intermediate portions of said valve stems, crossover passages leading from the poppet valve of each valve stem to the spool valve of the other valve stem, an outlet chamber connected to said spool valves, an exhaust port in said housing, and a pair of exhaust valves on said valve stems between said outlet chamber and said exhaust port.

DESCRIPTION OF THE PREFERRED EMBODIMENTS

Figure 1:
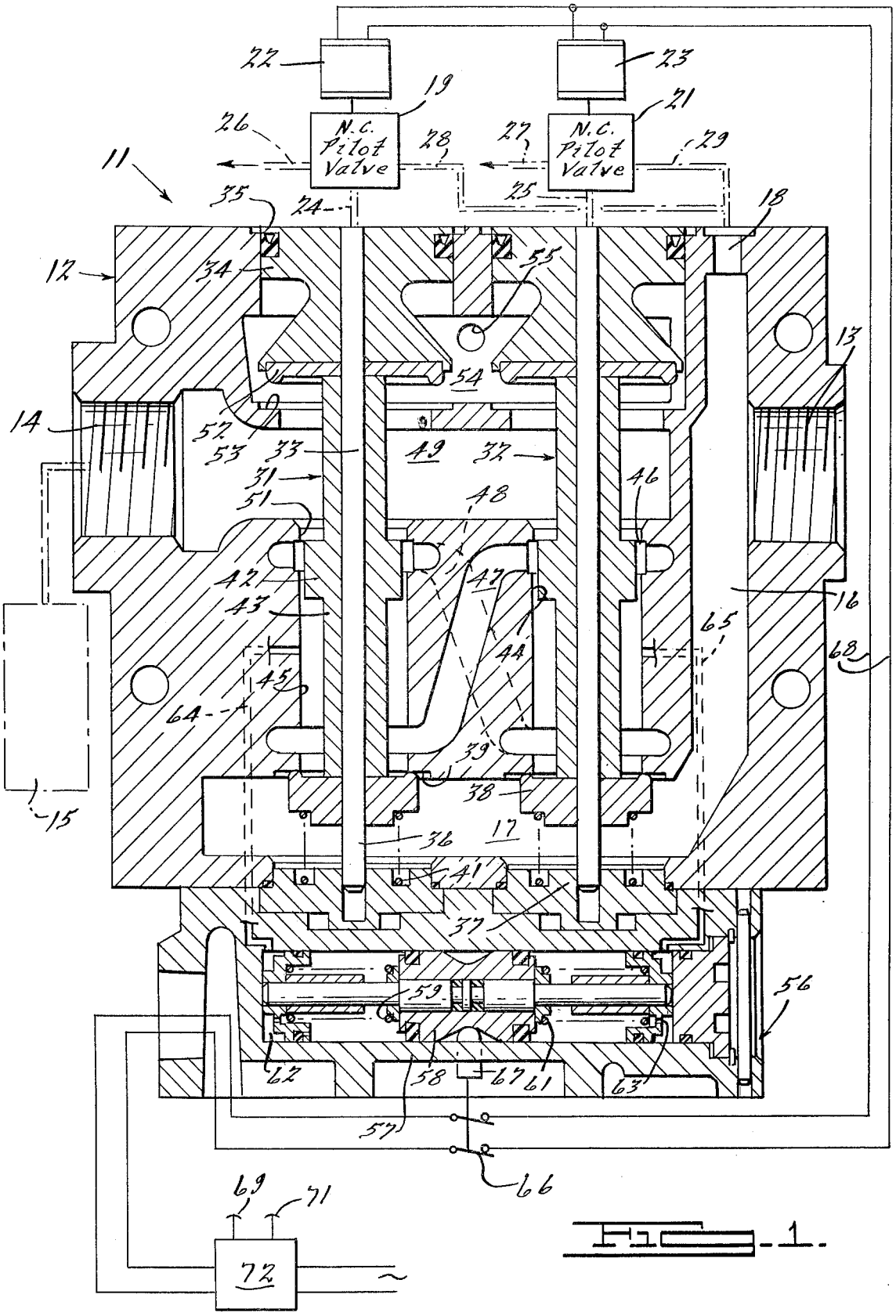
FIG. 1 is a partially schematic cross sectional view in elevation of the double safety valve of this invention together with normally closed solenoid operated pilot valves and a shuttle type of monitor.

Referring first to the embodiment of FIG. 1, the double safety valve of this invention is generally indicated at 11 and comprises a housing generally indicated at 12. The housing has an inlet port 13 at one side thereof and an outlet port 14 at the opposite side, the outlet port being connected to a volume 15 which may be the working chamber of a clutch-brake for a press. Conventionally, pressurizing of chamber 15 will cause the clutch to be engaged, operating the press, whereas exhausting of chamber 15 will result in the press brake being applied.

Inlet port 13 leads to a housing passage 16 which conducts pressurized fluid to an inlet chamber 17 adjacent the bottom portion of the housing. Passage 16 also leads to a port 18 which can supply two pilot valves shown schematically at 19 and 21. As illustrated, these could be normally closed three-way pilot valves operated by solenoids 22 and 23 respectively. When the solenoids are de-energized the passages 24 and 25 leading from the pilot valve outlet ports to the housing will be connected to pilot valve exhaust ports 26 and 27. When the solenoids are energized passages 24 and 25 will be supplied with pressurized fluid from port 18 which leads to supply ports 28 and 29.

A pair of valve stems generally indicated at 31 and 32 are provided in housing 12. The valve stems are of identical construction, each valve stem having a rod 33 extending therethrough with a piston 34 fixed to the upper end thereof. The piston is slidably mounted in a cylinder 35 supplied by passage 24 or 25.

Extensions 36 are formed at the lower ends of rods 33 and are supported by bearings 37 in the lower end of housing 12. The entire valve stem will thus be radially supported during its sliding movement at its opposite ends rather than in an intermediate portion thereof.

An inlet poppet valve 38 is secured to rod 33 above extension 36 and within chamber 17. This poppet valve is engageable with a seat 39 against which it is urged by a helical coil compression spring 41 disposed between the poppet valve and the lower end of housing 12. Since poppet valves 38 are subject to inlet chamber pressure upon closing, they will be held in a sealed condition.

A pair of spool valves 42 are formed on intermediate portions of valve stems 31 and 32. These spool valves are formed as enlargements on sleeves 43 carried by rod 33, which coact with lands 44 in bores 45 within the housing. As shown, spool valves 42 may be provided with a predetermined slight amount of clearance indicated at 46 so that any leakage of pressurized fluid will be predetermined and controlled. It should also be observed that the spool valves will not be subject to wear by rubbing or sliding against lands 44 because any side pressures on the valve stems will be resisted by pistons 34 and extensions 36 rather than by the spool valves themselves. Thus, after continued usage the slight leakage past the spool valves is predictable and will not exhibit any noticeable change.

A pair of crossover passages 47 and 48 are provided which lead from the inlet poppet valve of each valve stem to the spool valve of the other valve stem. That is, crossover passage 47 connects poppet valve 38 of valve stem 31 with spool valve 42 of valve stem 32, whereas passage 48 leads from poppet valve 38 of valve stem 32 to spool valve 42 of valve stem 31. Thus, the spool valves will act as inlet valves which are downstream from and in series with the poppet valves. An outlet chamber 49 is formed in housing 12 above spool valves 42, with passages 51 leading from the spool valves to this outlet chamber. Chamber 49 is connected with outlet port 14.

A pair of exhaust poppet valves 52 are formed at the ends of the valve stems 31 and 32 adjacent pistons 34. When the valve stems are in their deactivated position these exhaust valves are moved away from seat 53, permitting outlet chamber 49 to be connected to an exhaust chamber 54 having an exhaust port 55. Outlet port 14 is thus connected in parallel with exhaust port 55 whereas it is connected by each of two parallel paths from inlet port 13, each path having two valves in series.

Monitoring means generally indicated at 56 are provided for the double safety valve, in the form of a housing 57 having a spool 58. The spool is held in a centered position by a pair of springs 59 and 61 and has a pair of chambers 62 connected to the spool by restrictions 63. Spool 58 is shiftable to one side or the other by discrepant pressures between the two chambers.

A pair of sensing passages 64 and 65 are connected between bores 45 of valve stems 31 and 32 respectively and chambers 62 below. These may be relatively restricted passages which will sense the pressures in the bores, which is the same as the pressures in the crossover passages between poppet valves 38 and spool valves 42. Upon shifting of the spool due to discrepant pressures between the two chambers, a switch 66 is actuatable by a pin 67 moved by the spool. Switch 66 is in the supply lines 68 leading to solenoids 22 and 23. Alternatively, shifting of the spool could be used to shut off pressure to the double valve or its pilots.

In operation, assuming an initial condition in which the solenoids are de-energized, the double valve will be in the position shown in the figure. That is, both poppet valves 38 and both spool valves 42 will be closed, and outlet chamber 49 will be connected to exhaust port 55 through parallel exhaust valves 52. It should be observed that when in the position of the figure, there will be no pressure in bores 45 because of the slight predetermined leakage in spool valves 42. Both of the chambers 62 will therefore be de-pressurized and the spool 58 of monitor 56 will be centered. The fact that poppet valves 38 are aided in their closed positions by the pressure behind them will insure that there will be no pressure in bores 45.

Upon energization of pilot valve solenoids 22 and 23, such as by depression of a pair of palm buttons 69 and 71 to close the control switch shown schematically at 72, cylinders 35 will be pressurized and valve stems 31 and 32 shifted downwardly. This will open the inlet poppet valve 38 and the inlet spool valve 42 of each valve stem. Pressurized fluid will flow through the inlet poppet of valve stem 31 through the open spool valve 42 of valve stem 32 to the outlet chamber 49. Simultaneously, pressurized fluid will flow through the open poppet valve 38 of valve stem 32 and through the spool valve 42 of valve stem 31 to the outlet chamber. Exhaust valves 52 will be closed and volume 15 will be pressurized.

Bores 45 will achieve full line pressure practically simultaneously and pressurize the two chambers 62 of the monitor so that spool 58 will remain in its centered position. The restricted nature of sensing passages 64 and 65 will prevent any slight discrepancy between the pressurizing of the two bores 45 from affecting the monitor. However, it is known that the repeated pressurizing and de-pressurizing of the two chambers 62 will enhance the reliability of monitor 56 when and if it is needed, in that there will be repeated slight movements of spool 58, called "dithering", which will ensure that the spool will not be stuck when it is to be shifted to its safety position.

De-energization of pilot valve solenoids 22 and 23 will exhaust piston chambers 35, and springs 41 aided by the inlet pressure in chamber 17 will shift the two valve stems upwardly, opening exhaust valves 52 and closing poppet valves 38 and spool valves 42. Volume 15 will thus be exhausted and the pressures in both monitor chambers 62 will also drop to zero, again giving the slight movement to spool 58 which maintains its reliability. It should be observed that during the downward and upward movement of both valve stems, spool valves 42 will not rub against their lands 44 and there will thus be little or no wear or erosion which could increase leakage of the spool valves.

Should the right hand valve stem 32 be stuck in its exhaust position when valve stem 31 moves downwardly to its supply position, poppet valve 38 of valve stem 32 will remain closed and there will thus be no supply of pressurized fluid through its downstream spool valve 42 which opens. Poppet valve 38 of valve stem 31 will open and supply fluid pressure to closed spool valve 42 of valve stem 32. While there will be slight leakage of pressurized fluid through this spool valve to the outlet chamber, it will be a pre-determined quantity since spool valves 42 will have no appreciable wear, and this leakage will be insufficient to fill volume 15 and actuate the press clutch. Instead this slight leakage will flow out through the open exhaust valve 52 of valve stem 32. The discrepant pressures, that is full line pressure in bore 45 of valve stem 31 and zero pressure in bore 45 of valve stem 32, will be sensed and transmitted to both chambers 62 of the monitor. Spool 58 will shift to the right, operating pin 67 to open switch 66 and thus de-energize both solenoids 22 and 23. This will cause valve stem 31 to return to its closed position at which it will remain until the fault is corrected.

Should valve stem 31 be stuck in its exhaust position when valve stem 32 is moved to its inlet or supply position, there will be no supply fluid pressure through the closed poppet valve 38 of valve stem 31. Fluid pressure flowing to the spool valve 42 of valve stem 31 through the open poppet valve 38 of valve stem 32 will, as before, result in a slight and pre-determined amount of leakage and will be drawn off through exhaust valve 52 of valve stem 31 to the exhaust port. This time the discrepant pressures will be such that spool 58 of the monitor will be shifted to the left, again disenabling the solenoids and causing both valves to return to their exhaust position.

Figure 2:
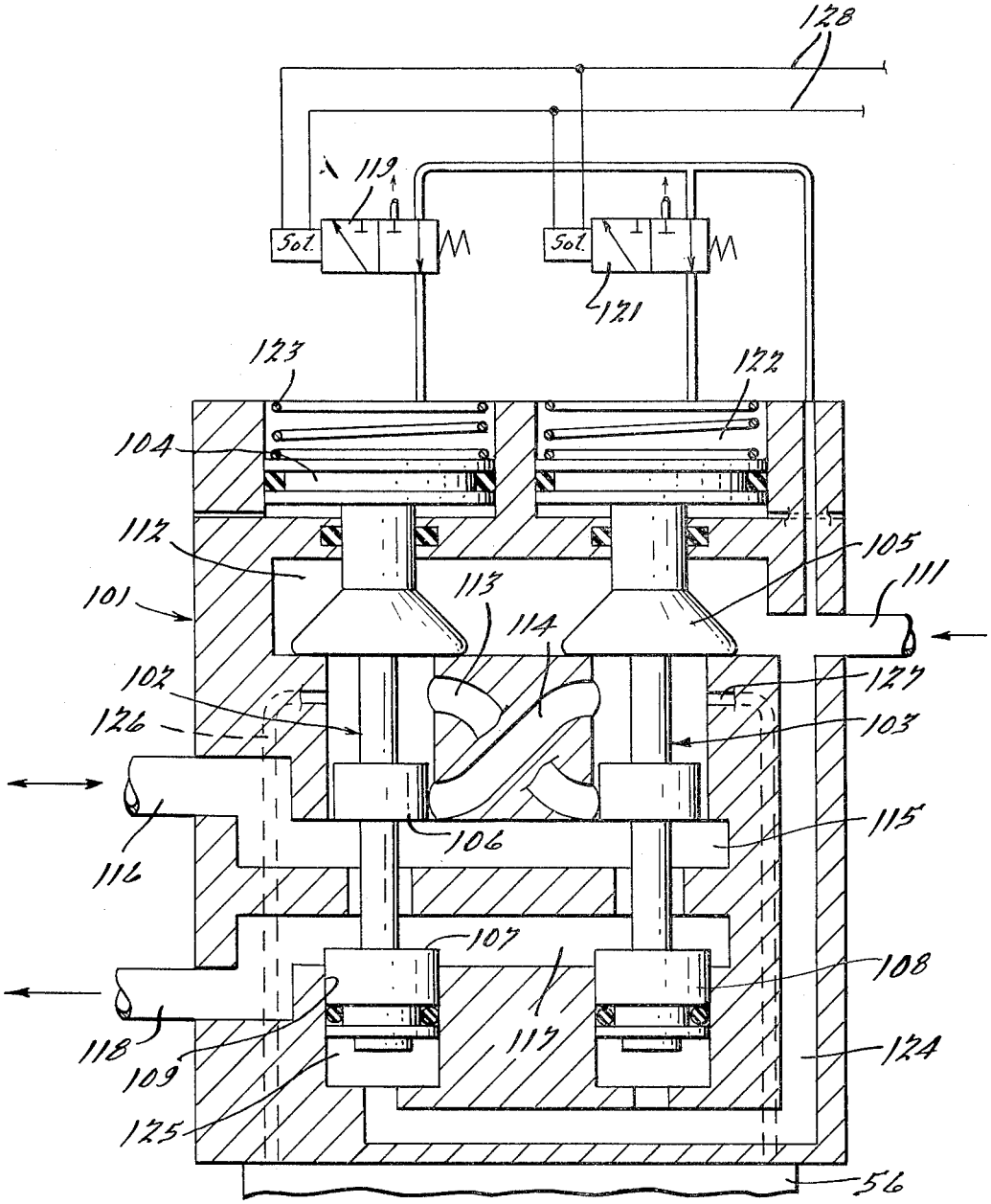
FIG. 2 is a view similar to FIG. 1 but showing a modified form of the invention with normally open pilots.

FIG. 2 shows a modified form of the invention which is basically similar to FIG. 1 but is used with normally open pilot valves. The housing is generally indicated at 101 and comprises a pair of valve stems generally indicated at 102 and 103. Each valve stem has a piston 104 at one end, an inlet poppet valve 105 adjacent the piston, a spool valve 106 at an intermediate portion and an exhaust poppet valve 107 at the other end of the valve stem. The exhaust valve is combined with an extension 108 supported by a bearing 109 at the lower end of the housing .

An inlet port 111 leads to a chamber 112 within which poppet valves 105 are disposed. Crossover passages 113 and 114 lead from the poppet valves to the spool valves of the opposite valve stem as in the previous embodiment. An outlet chamber 115 connected to the spool valves leads to an outlet port 116. Exhaust valves 107 connect outlet chamber 115 to an exhaust chamber 117 leading to an exhaust port 118.

A pair of normally open solenoid operated pilot valves 119 and 121 are connected with piston chambers 122. These pilot valves are supplied from inlet port 111 and, when their solenoids are de-energized, will pressurize chambers 122 as shown in FIG. 2, holding the main valve stems in their closed positions. Springs 123 are provided for urging the valve stems toward their closed positions. Alternatively, a spring could be provided below valve stem 102 instead of the spring 123 shown. The illustrated arrangement is necessary where a monitor such as monitoring means 56 of the first embodiment is being used in conjunction with the double safety valve. A spring urging valve stem 102 to its open position, instead of the spring shown, would be preferable if, instead of monitor 56, the valve stems were being used to control directly two monitoring limit switches (not shown). In that case, an asynchronous or safety position of the two limit switches, disenabling the solenoids, would be obtained by the above described alternate spring arrangement in the event there is a failure of the air supply. This would prevent the possibility of the press being accidentally driven when pressure is re-established.

A passage 124 leads from inlet port 111 to chambers 125 at the ends of extensions 108. Thus, there will be constant pressure urging the valve stems to their open position. A pair of restricted sensing passages 126 and 127 are provided, leading from the bores of the valve stems between inlet poppet valves 105 and spool valves 106. These sensing passages are connected to the opposite chambers (not shown) of monitoring means 56. This monitoring means, as in the previous embodiment, is connected by electrical conduits 128 to solenoid operated pilot valves 119 and 121.

In operation of the embodiment of FIG. 2, assuming an initial condition in which the solenoids of pilot valves 119 and 121 are de-energized, the double valve will be in the position shown in FIG. 2. Outlet port 116 will be connected to exhaust port 118 and the monitoring spool will be centered because of no pressure in sensing passages 126 and 127.

Upon energization of the pilot valve solenoids, chambers 122 will be exhausted. The pressure in chambers 125 will shift valve stems 102 and 103 upwardly. This will connect inlet port 111 to outlet port 116 and close the exhaust valves. The monitor spool will remain in its centered position although the slight movement of the spool will have the advantages described above with respect to the previous embodiment. De-energization of the solenoid pilots will cause valve stems 102 and 103 to again move downwardly. As in the previous embodiment, spool valves 106 will not rub against their lands and there will be minimal wear or erosion.

Should valve stem 103 be stuck in its exhaust position when valve stem 102 moves to its supply position, the discrepant pressures in the two sensing passages 126 and 127 will cause shifting of the monitor spool, opening switch 66 and de-energizing the pilot valve solenoids. This will cause valve stem 102 to return to its exhaust position. Similarly, should valve stem 102 be stuck in its exhaust position when the valve stem moves to its supply position, the discrepant pressures will again be such as to shift the monitor spool and cause both valves to return to their exhaust positions. In either case, the outlet port 116 will be cut off from its supply pressure and connected instead to exhaust port 118.

While it will be apparent that the preferred embodiments of the invention disclosed are well calculated to fulfill the objects above stated, it will be appreciated that the invention is susceptible to modification, variation and change without departing from the proper scope or fair meaing of the subjoined claims.

I claim:

1. In a double safety valve, a housing, a pair of valve stems in said housing, pistons slidable in housing cylinders at one end of said valve stems, extensions at the other ends of said valve stems slidable in bearings in said housing, whereby the valve stems are radially supported at their opposite ends by said cylinders and bearings, an inlet chamber, poppet valves carried by said valve stems in said inlet chamber, spool valves on intermediate portions of said valve stems, crossover passages leading from the poppet valve of each valve stem to the spool valve of the other valve stem, an outlet chamber connected to said spool valves, an exhaust port in said housing, and a pair of exhaust valves on said valve stems between said outlet chamber and said exhaust port.

2. The combination according to claim 1, said spool valves havinga pre-determined slight leakage.

3. The combination according to claims 1 or 2, further provided with monitoring means responsive to discrepant pressures at corresponding locations of the double valve to disenable the double valves.

4. The combination according to claim 3, said monitoring means comprising a shuttle, and sensing passages connected to said crossover passages and leading to said monitoring means, said sensing passages being connected to opposite sides of said shuttle.

5. The combination according to claim 3, further provided with pilot valves for said cylinders, solenoids operating said pilot valves, and means connected to said monitoring means disenabling said solenoids in response to discrepant pressures between corresponding locations of said double valve.

6. The combination according to claim 1, further provided with resilient means urging said poppet valves to their closed positions.

7. The combination according to claims 1, 2 or 6, said cylinders, when pressurized, causing said poppet valves to open and said exhaust valves to close, pilot valves for said cylinders, and solenoids operating said pilot valves, the pilot valves being normally closed whereby said cylinders will be depressurized when the solenoids are de-energized.

8. The combination according to claim 7, said inlet chamber being adjacent said bearings.

9. The combination according to claim 8, further provided with monitoring means responsive to discrepant pressures at corresponding locations of the double valve to disenable the double valve, and sensing passages connected to said crossover passages and leading to said monitoring means.

10. The combination according to claims 1, 2 or 6, said cylinders, when pressurized, causing said poppet valves to close and said exhaust valves to open, pilot valves for said cylinders, and solenoids operating said pilot valves, the pilot valves being normally open whereby said cylinders will be pressurized when said solenoids are de-energized.

11. The combination according to claim 10, said inlet chamber being adjacent said pistons.

12. The combination according to claim 11, further provided with monitoring means responsive to discrepant pressures at corresponding locations of the double valve to disenable the double valve, and sensing passages connected to said crossover passages and leading to said monitoring means.

13. The combination according to claim 6, further provided with additional resilient means of greater strength than said first-mentioned resilient means urging said poppet valves toward their open position.

14. The combination according to claims 1, 2 or 6, said exhaust valves comprising poppet valves.

15. The combination according to claim 14, said exhaust valves being adjacent said pistons.

16. The combination according to claim 14, said exhaust valves being adjacent said valve stem extensions.

* * * * *